US009812767B2

(12) United States Patent
Zhao et al.

(10) Patent No.: US 9,812,767 B2
(45) Date of Patent: Nov. 7, 2017

(54) WIRELESS BASE STATION

(71) Applicant: Huawei Technologies Co., Ltd., Shenzhen (CN)

(72) Inventors: Chunbo Zhao, Shanghai (CN); Chang Shi, Shanghai (CN); Minghui Zheng, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/291,225

(22) Filed: Oct. 12, 2016

(65) Prior Publication Data

US 2017/0033446 A1 Feb. 2, 2017

Related U.S. Application Data

(63) Continuation of application No. PCT/CN2015/073516, filed on Mar. 2, 2015.

(30) Foreign Application Priority Data

Apr. 16, 2014 (CN) ..... 2014 1 0151961

(51) Int. Cl.
*H01Q 1/12* (2006.01)
*H01Q 3/02* (2006.01)
(Continued)

(52) U.S. Cl.
CPC ..... *H01Q 1/246* (2013.01); *H01Q 1/125* (2013.01); *H01Q 1/1207* (2013.01); *H01Q 1/36* (2013.01); *H01Q 3/08* (2013.01); *H01Q 1/42* (2013.01)

(58) Field of Classification Search
CPC ..... H01Q 1/1207; H01Q 1/125; H01Q 1/246; H01Q 1/36; H01Q 1/42; H01Q 3/08; H01Q 1/12; H01Q 3/02
See application file for complete search history.

(56) References Cited

U.S. PATENT DOCUMENTS 6,232,928 B1 5/2001 Zimmerman et al.
7,046,210 B1 * 5/2006 Brooker ..... H01Q 3/08 343/880
(Continued)

FOREIGN PATENT DOCUMENTS

CN 202855889 U 4/2013
EP 2408060 A1 1/2012
(Continued)

OTHER PUBLICATIONS

Machine Translation and Abstract of Chinese Publication No. CN202855889, Apr. 3, 2013, 2 pages.
(Continued)

*Primary Examiner* — Tho G Phan
(74) *Attorney, Agent, or Firm* — Conley Rose, P.C.

(57) ABSTRACT

A wireless base station, relates to the field of communications technologies, and is designed to implement more precise adjustment and control of a device, and to enable the device to have a compact form and high integrity. The wireless base station includes a supporting module and a base station module. The wireless base station further includes a first connecting part. The base station module is slidably disposed on the supporting module in a first sliding direction using the first connecting part, where a first sliding slot matching the first connecting part is disposed on the supporting module, so as to limit a sliding track and a sliding range of the base station module, and the first sliding slot is in an arc shape. The present disclosure may be used for manufacturing a communications device.

17 Claims, 6 Drawing Sheets

(51) Int. Cl.

| | |
|---|---|
| ***H01Q 1/24*** | (2006.01) |
| ***H01Q 1/36*** | (2006.01) |
| ***H01Q 3/08*** | (2006.01) |
| *H01Q 1/42* | (2006.01) |

(56) References Cited

U.S. PATENT DOCUMENTS

| | | | | |
|---|---|---|---|---|
| 2005/0052335 | A1* | 3/2005 | Chen | H01Q 19/132 343/878 |
| 2008/0150831 | A1* | 6/2008 | Tulloch | H01Q 3/08 343/882 |
| 2010/0127946 | A1* | 5/2010 | Tung | H01Q 3/08 343/763 |
| 2011/0032172 | A1* | 2/2011 | Kirby | H01Q 1/084 343/878 |
| 2011/0193764 | A1* | 8/2011 | Shen | H01Q 3/02 343/882 |

FOREIGN PATENT DOCUMENTS

| | | |
|---|---|---|
| JP | 2013021456 A | 1/2013 |
| WO | 2009008601 A1 | 1/2009 |

OTHER PUBLICATIONS

Machine Translation and Abstract of Japanese Publication No. JP2013021456, Jan. 31, 2013, 31 pages.

Foreign Communication From A Counterpart Application, European Application No. 15780532.6, Extended European Search Report dated Mar. 9, 2017, 9 pages.

Foreign Communication From A Counterpart Application, PCT Application No. PCT/CN2015/073516, English Translation of International Search Report dated May 29, 2015, 2 pages.

Foreign Communication From A Counterpart Application, PCT Application No. PCT/CN2015/073516, English Translation of Written Opinion dated May 29, 2015, 6 pages.

* cited by examiner

WIRELESS BASE STATION

CROSS-REFERENCE TO RELATED APPLICATIONS

This application is a continuation of International Application No. PCT/CN2015/073516, filed on Mar. 2, 2015, which claims priority to Chinese Patent Application No. 201410151961.2, filed on Apr. 16, 2014. The disclosures of the aforementioned applications are hereby incorporated by reference in their entireties.

TECHNICAL FIELD

The present disclosure relates to the field of communications technologies, and in particular, to a wireless base station.

BACKGROUND

Explosive growth of voice and data traffic on a mobile network makes it increasingly difficult to acquire a site of a conventional macro base station, and a small cell is being used as a measure to solve network congestion. A supporting module (usually referred to as a dock configured to supply power to a base transceiver station and transmit a signal), a base transceiver station (BTS), an antenna, and the like included in a main site device of the small cell are all installed together. Because the antenna is integrated into the device, a left or right azimuth and an upward or downward tilt of the antenna need to be adjusted when the device is mounted.

The small cell is generally mounted to a pole, the base transceiver station and the antenna are fixed into an integral structure, and are assembled to a cantilever beside the supporting module using a cross shaft, and the left or right azimuth and an upper or lower pitch angle of the antenna are adjusted by rotating the cross shaft.

However, the following technical problems arise in the foregoing adjustment process: the base transceiver station and the antenna rotate together around the cross shaft to implement adjustment of the left or right azimuth and the upper or lower pitch angle of the antenna, degrees are generally marked at a place around a rotation axis in an existing angle marking manner, rotational movement at the place around the rotation axis is small at a same rotation angle, and therefore adjustment and control are not precise; to ensure an adjustment range of an antenna angle, space needs to be reserved between the base transceiver station and the supporting module, resulting in loose forming of the device and poor integration with the environment.

SUMMARY

An objective of the present disclosure is to provide a wireless base station, which can enable adjustment and control of a device to be more precise, and meanwhile enable the device to have a compact form and high integrity.

To achieve the foregoing objective, the following technical solutions are used in embodiments of the present disclosure:

A first aspect of the present disclosure provides a wireless base station, including a supporting module and a base station module, where the wireless base station further includes a first connecting part, the base station module is slidably disposed on the supporting module in a first sliding direction using the first connecting part, a first sliding slot matching the first connecting part is disposed on the supporting module, so as to limit a sliding track and a sliding range of the base station module, and the first sliding slot is in an arc shape.

In a first possible implementation manner of the first aspect, a first side face that is on the base station module, adjacent to the supporting module, and directly opposite the supporting module and a second side face that is on the supporting module, adjacent to the base station module, and directly opposite the base station module match each other in shape, to prevent interference from the supporting module when the base station module slides in the first sliding direction.

With reference to the first possible implementation manner of the first aspect, in a second possible implementation manner of the first aspect, the first side face of the base station module is in an arc shape, or the first side face of the base station module is in an arc shape, the second side face of the supporting module is also in an arc shape, and curvature of the first side face is greater than or equal to curvature of the second side face.

With reference to the second possible implementation manner of the first aspect, in a third possible implementation manner of the first aspect, the first sliding slot is disposed on an end face that is on the supporting module, adjacent to the second side face of the supporting module, and corresponding to the first connecting part, and curvature of the first sliding slot is consistent with the curvature of the first side face of the base station module.

With reference to the first aspect or the first or second or third possible implementation manner of the first aspect, in a fourth possible implementation manner of the first aspect, the base station module includes a base transceiver station, an antenna, and a second connecting part, where the antenna is slidably disposed on the base transceiver station in a second sliding direction using the second connecting part, and the first side face of the base station module is formed on an opposite side of a side on which the antenna is disposed, on the base transceiver station.

With reference to the fourth possible implementation manner of the first aspect, in a fifth possible implementation manner of the first aspect, a second sliding slot matching the second connecting part is disposed on the base transceiver station, so as to limit a sliding track and a sliding range of the antenna, and the second sliding slot is in an arc shape, and is disposed on a projection that is on the base transceiver station and is on a side adjacent to the antenna.

With reference to the fourth or the fifth possible implementation manner of the first aspect, in a sixth possible implementation manner of the first aspect, the first sliding direction is perpendicular to the second sliding direction.

With reference to the first aspect or any one of the first to sixth possible implementation manners of the first aspect, in a seventh possible implementation manner of the first aspect, the supporting module has a scale that is located on the second side face and is along the first sliding slot, so that a degree that the base station module slides relative to the supporting module is recorded.

With reference to the fifth or sixth possible implementation manner of the first aspect, in an eighth possible implementation manner of the first aspect, a scale that is distributed along the second sliding slot is disposed on a side face of the projection.

With reference to the first aspect or any one of the first to eighth possible implementation manners of the first aspect, in a ninth possible implementation manner of the first aspect, an inner wall of the first sliding slot is smooth, and the first connecting part includes a sliding block part and a fixed part, where the fixed part is disposed on an end face of the base transceiver station, and the sliding block part is disposed inside the first sliding slot; or teeth are provided on an inner wall of the first sliding slot, and the first connecting part includes a gear part and a fixed part, where the fixed part is disposed on an end face of the base transceiver station, and the gear part is disposed inside the first sliding slot and meshes with the teeth that are on the inner wall of the first sliding slot.

With reference to the fifth or sixth or eighth possible implementation manner of the first aspect, in a tenth possible implementation manner of the first aspect, an inner wall of the second sliding slot is smooth, and the second connecting part includes a sliding block part and a fixed part, where the fixed part is disposed on an end face of the antenna, and the sliding block part is disposed inside the second sliding slot, or an inner wall of the second sliding slot is toothed, and the second connecting part includes a gear part and a fixed part, where the fixed part is disposed on an end face of the antenna, and the gear part is disposed inside the second sliding slot.

With reference to the first aspect or any one of the first to tenth possible implementation manners of the first aspect, in an eleventh possible implementation manner of the first aspect, the supporting module includes a body and an adapter portion that is installed on the body and that may move relative to the body, so that the adapter portion drives the base station module to rotate together with the adapter portion relative to the body of the supporting module; and the first sliding slot on the supporting module is separately disposed on an upper end face and a lower end face of the adapter portion.

With reference to the eleventh possible implementation manner of the first aspect, in a twelfth possible implementation manner of the first aspect, the adapter portion is formed in a door-shaped structure, where: a side of the adapter portion with the door-shaped structure is pivotally connected to a side of the body, and another side is fitted to another side of the body using a latch or a pin; or the adapter portion with the door-shaped structure is slidably disposed on the body in a push-pull manner.

In the embodiments of the present disclosure, a base station module is slidably disposed on a supporting module in a first sliding direction using a first connecting part, and the base station module slides along a first sliding slot on the supporting module, where the first sliding slot is in an arc shape, and the first sliding slot is directly disposed on the supporting module. The base station module rotates with a larger radius, and a rotational axis center is positioned farther away from the base station module. A user may control angle adjustment precision by designing a position that can be moved and that is far away from the axis center but close to the base station module. Adjusting a same angle requires a longer moving distance, thereby achieving higher angle adjustment precision and lowering an angle adjustment skill requirement for the user. Further, the base station module rotates in combination with the supporting module, with no need of a long rotational radius axis, and therefore an overall form of a device is more compact.

DESCRIPTION OF EMBODIMENTS

Figure 1:
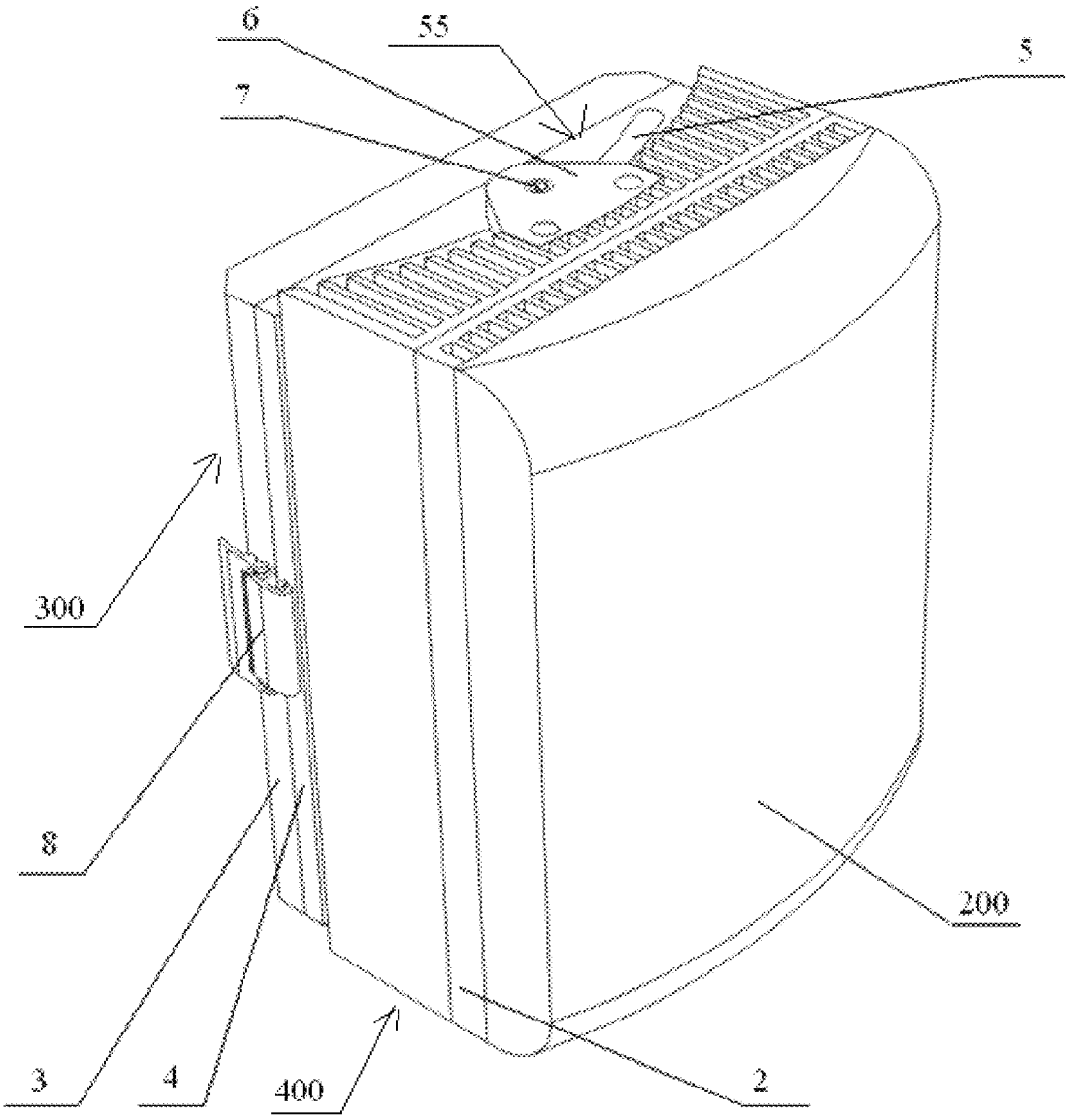
FIG. 1 is a schematic diagram of a wireless base station as a whole according to Embodiment 1 of the present disclosure.
Figure 2:
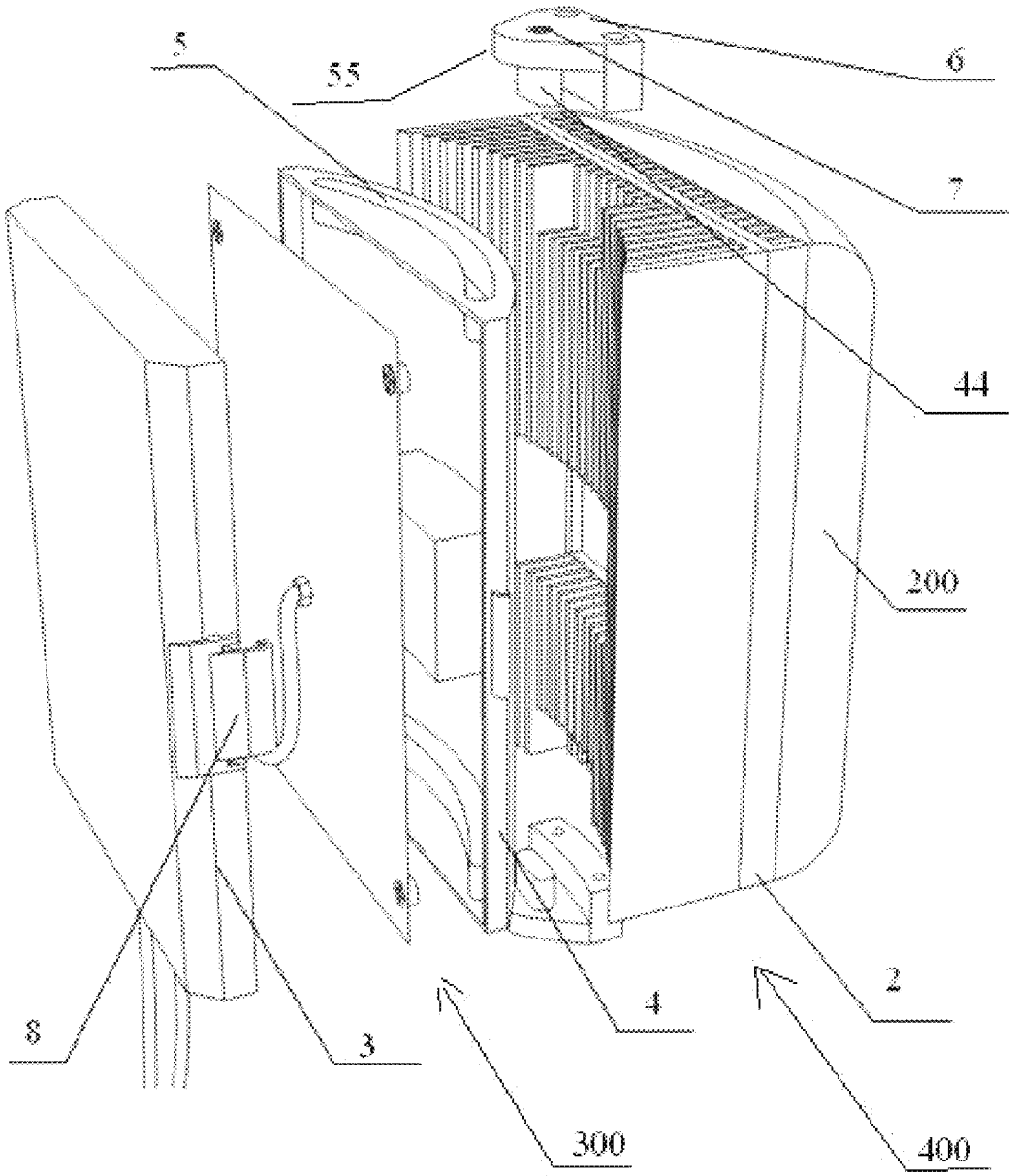
FIG. 2 is a schematic exploded view of a wireless base station according to Embodiment 1 of the present disclosure.
Figure 3:
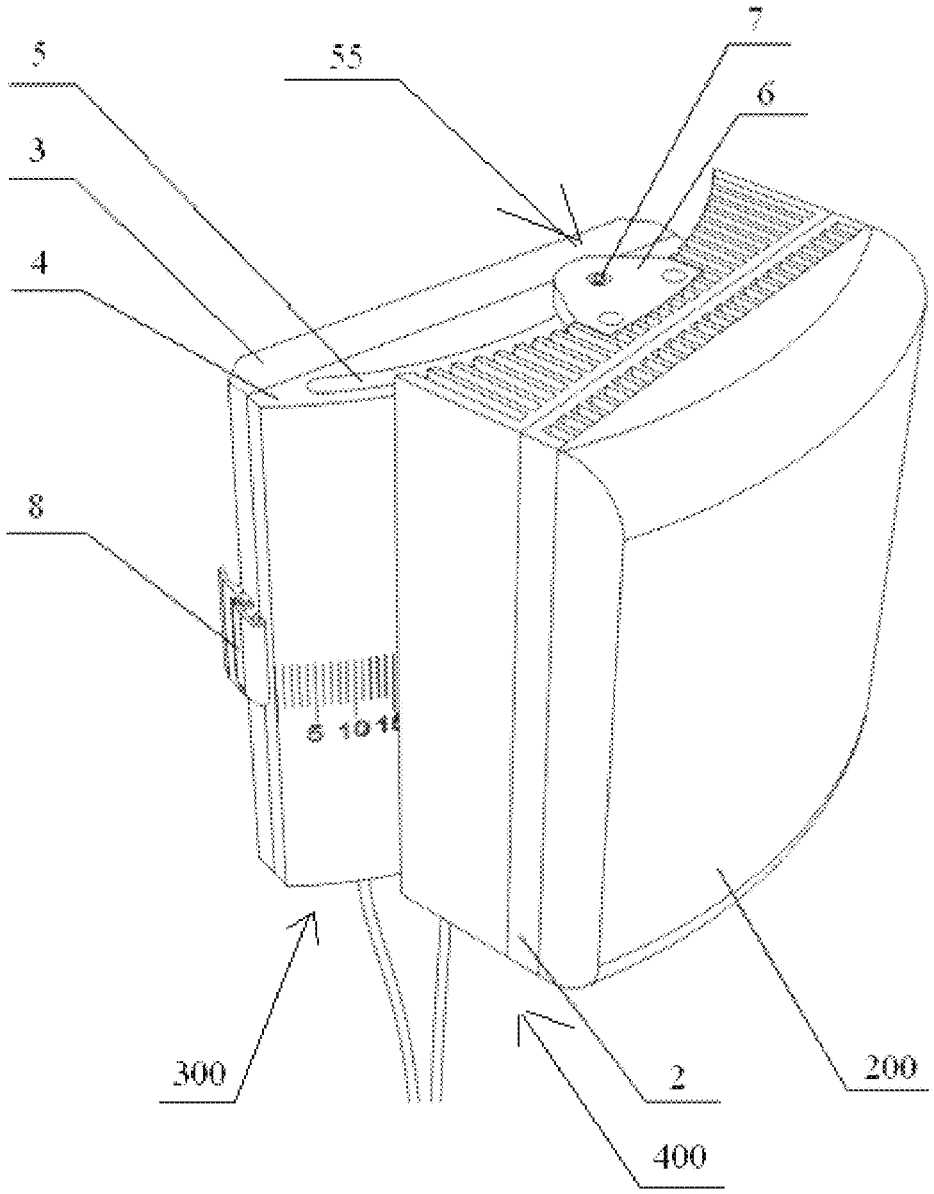
FIG. 3 is a schematic diagram of a wireless base station after the base transceiver station of a wireless base station slides a certain angle relative to an adapter portion according to Embodiment 1 of the present disclosure.
Figure 4:
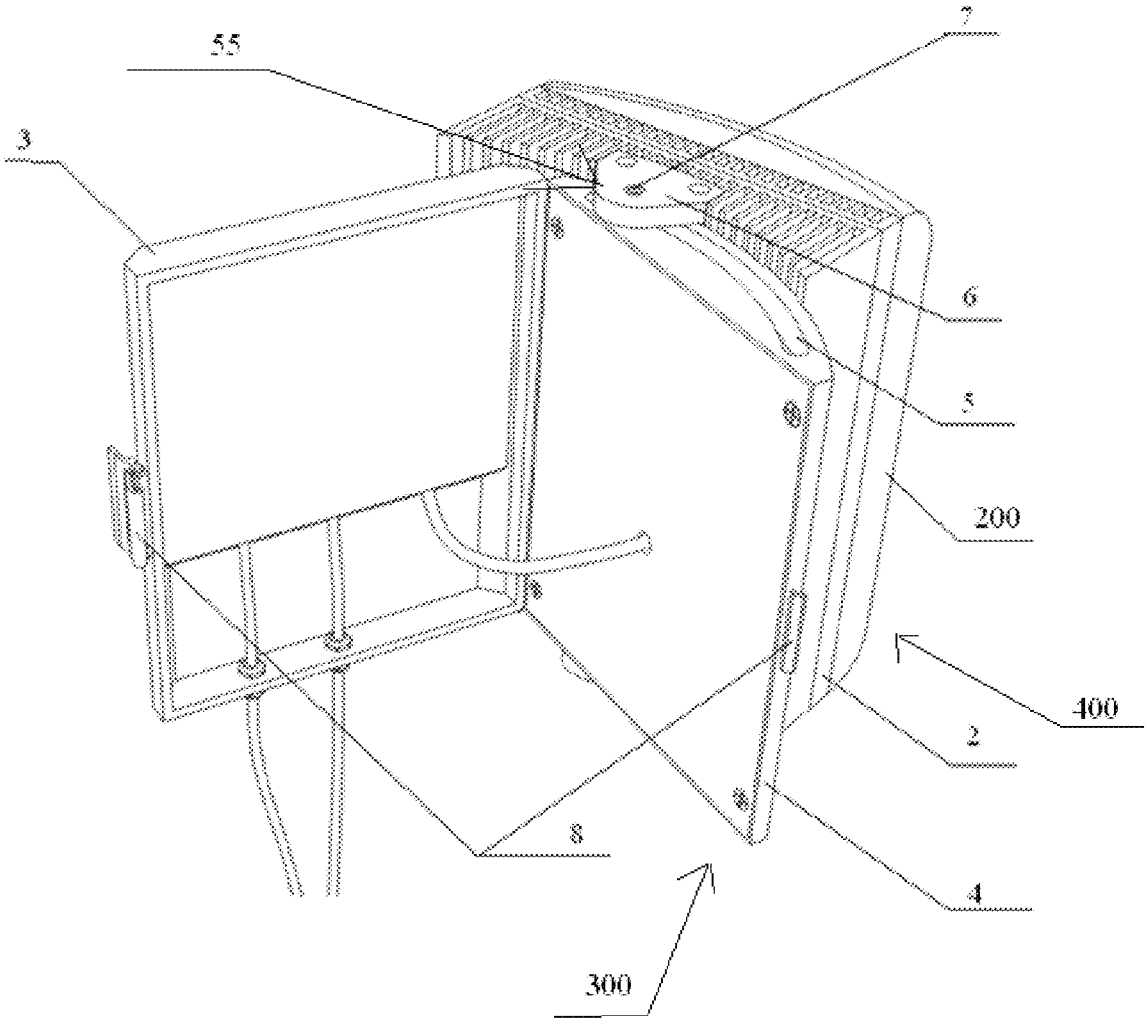
FIG. 4 is a schematic diagram of a wireless base station when an adapter portion of the wireless base station is far away from a supporting module according to Embodiment 1 of the present disclosure.

The following describes a wireless base station of an embodiment of the present disclosure in detail with reference to the accompanying drawings.

As shown in FIG. 1 to FIG. 6, the wireless base station provided by the present disclosure includes a supporting module 300 and a base station module 400. The wireless base station further includes a first connecting part 55. The base station module 400 is slidably disposed on the supporting module 300 in a first sliding direction using the first connecting part 55, where a first sliding slot 5 matching the first connecting part 55 is disposed on the supporting module 300, so as to limit a sliding track and a sliding range of the base station module 400, and the first sliding slot 5 is in an arc shape.

A manner of adjusting a azimuth of the base station module 400 in this solution is that the base station module 400 slides along the first sliding slot 5 on the supporting module 300, where the first sliding slot 5 is in an arc shape. The first sliding slot 5 is directly disposed on the supporting module 300, so that the first sliding slot 5 may have a larger radius, and the base station module 400 rotates with a larger radius, that is, a rotational axis center is positioned farther away from the base station module 400. A user may control angle adjustment precision by designing a position that can be moved and that is far away from the axis center but close to the base station module 400. Adjusting a same angle requires a longer moving distance of the base station module 400, thereby achieving higher angle adjustment precision and lowering an angle adjustment skill requirement for the user. Further, the base station module 400 rotates in combination with the supporting module 300, with no need of a long rotational radius axis, and therefore an overall form of a device is more compact.

Further, a first side face that is on the base station module 400, adjacent to the supporting module 300, and directly opposite the supporting module 300 and a second side face that is on the supporting module 300, adjacent to the base station module 400, and directly opposite the base station module 400 match each other in shape, to prevent interference from the supporting module 300 when the base station module 400 slides in the first sliding direction. The base station module 400 and the supporting module 300 match each other via opposite faces of the base station module 400 and the supporting module 300, so that rotation is performed more smoothly during angle adjustment. In addition, the first side face and the second side face that match each other may enable the device to have higher appearance integrity and a more compact form. After the base station module 400 rotates a certain angle relative to the supporting module 300, the two faces still match each other, and therefore device appearance is maintained well in terms of integrity and aesthetics throughout an adjustment process.

Furthermore, the first side face of the base station module 400 is in an arc shape, or the first side face of the base station module 400 is in an arc shape, the second side face of the supporting module 300 is also in an arc shape, and curvature of the first side face is greater than or equal to curvature of the second side face. When the first side face is in the arc shape or both the first side face and the second side face are in the arc shape, this type of arc shape matching may enable the two side faces fit more closely, thereby further ensuring the overall form of the device. When the curvature of the first side face is greater than or equal to the curvature of the second side face, the base station module 400 may be fitted to the supporting module 300 without wobbling relative to the supporting module 300.

In addition, the first sliding slot 5 is disposed on an end face that is on the supporting module 300, adjacent to the second side face of the supporting module 300, and corresponding to the first connecting part 55, and curvature of the first sliding slot 5 is consistent with the curvature of the first side face of the base station module 400. The sliding slot disposed in this way may ensure proper relative movement of the base station module 400 and the supporting module 300.

In addition, the base station module 400 includes a base transceiver station 2, an antenna 1, and a second connecting part 66. The antenna 1 is slidably disposed on the base transceiver station 2 in a second sliding direction using the second connecting part 66. The first side face of the base station module 400 is formed on an opposite side of a side on which the antenna 1 is disposed, on the base transceiver station 2. An antenna housing 200 may be mounted to an outer side of the base transceiver station 2. The antenna 1 is adjusted in a second direction, and the base station module 400 is adjusted relative to the supporting module 300 in a first direction, so that the antenna 1 can be adjusted in all directions of space. In addition, the antenna 1 is also slidably disposed on the base transceiver station 2 and slides in a way similar to sliding of the base station module 400 relative to the supporting module 300, which may improve adjustment precision and facilitate adjustment and control.

A second sliding slot 9 matching the second connecting part 66 is disposed on the base transceiver station 2, so as to limit a sliding track and a sliding range of the antenna 1, and the second sliding slot 9 is in an arc shape, and is disposed on a projection 33 that is on the base transceiver station 2 and is on a side adjacent to the antenna 1. The second connecting part 66 is enabled to slide in the second sliding slot 9, so that connection is well fit and sliding is smooth.

The first sliding direction is perpendicular to the second sliding direction. Separate sliding in two directions perpendicular to each other is more beneficial to adjustment of the antenna 1 in all directions of space.

Generally, the supporting module 300 has a scale that is located on the second side face and is along the first sliding slot 5, so that an angle at which the base station module 400 slides relative to the supporting module 300 is recorded. This type of marking manner is visual and concise in a way that a mark that is revealed after the base station module 400 rotates relative to the supporting module 300 is an angle at which the base station module 400 rotates.

Similarly, a scale that is distributed along the second sliding slot 9 is provided on a side face of the projection 33.

Optionally, an inner wall of the first sliding slot 5 is smooth, and the first connecting part 55 includes a sliding block part 44 and a fixed part 6, where the fixed part 6 is disposed on an end face of the base transceiver station 2, and the sliding block part 44 is disposed inside the first sliding slot 5. Engaging a sliding block with a sliding rail is simple and feasible. A screw 7 may be mounted on the sliding block part 44, and is used to lock an angle after adjustment is completed. Alternatively, teeth (not shown) are provided on an inner wall of the first sliding slot 5, and the first connecting part 55 includes a gear part and a fixed part 6, where the fixed part 6 is disposed on an end face of the base transceiver station 2, and the gear part is disposed inside the first sliding slot 5 and meshes with the teeth that are on the inner wall of the first sliding slot 5. A manner of using a gear and a toothed rail may make it easier to control an angle at which rotation is performed.

Similarly, an inner wall of the second sliding slot 9 is smooth, and the second connecting part 66 includes a sliding block part 44 and a fixed part 6, where the fixed part 6 is disposed on an end face of the antenna 1, and the sliding block part 44 is disposed inside the second sliding slot 9. Alternatively, an inner wall of the second sliding slot 9 is toothed, and the second connecting part 66 includes a gear part and a fixed part 6, where the fixed part 6 is disposed on an end face of the antenna 1, and the gear part is disposed inside the second sliding slot 9.

In addition, the supporting module 300 includes a body 3 and an adapter portion 4 that is mounted to the body 3 and that may move relative to the body 3, so that the adapter portion 4 drives the base station module 400 to rotate together with the adapter portion 4 relative to the body 3 of the supporting module 300; and the first sliding slot 5 on the supporting module 300 is separately disposed on an upper end face and a lower end face of the adapter portion 4.

In the wireless base station provided by the foregoing embodiment, the adapter portion 4 that may move relative to the supporting module 300 is disposed on the supporting module 300, a mechanism for adjusting an angle of the antenna 1 is disposed on the adapter portion 4, and the mechanism for adjusting the angle of the antenna 1 is connected to the base transceiver station 2 and the antenna 1. Therefore, the mechanism for adjusting the angle of the antenna 1 can be formed integrally with the base transceiver station 2 and the antenna 1, and move together with the adapter portion 4 to be far away from or close to the supporting module 300. In addition, an adjusted angle that is obtained when the base transceiver station 2 and the antenna 1 move as a whole with the mechanism for adjusting the angle of the antenna 1 does not vary with movement of the adapter portion 4 relative to the supporting module 300. Therefore, when the supporting module 300 is maintained, the base transceiver station 2 and the antenna 1 can be kept far away from the supporting module 300 using the adapter portion 4, which facilitates maintenance of the supporting module 300 without disrupting a previously adjusted angle of the antenna 1. In this case, after maintenance of the supporting module 300 is completed, the adapter portion 4 together with the base transceiver station 2 and the antenna 1 can be restored to an initial position, the angle of the antenna 1 is not changed, and therefore the angle of the antenna 1 does not need to be readjusted.

Figure 5:
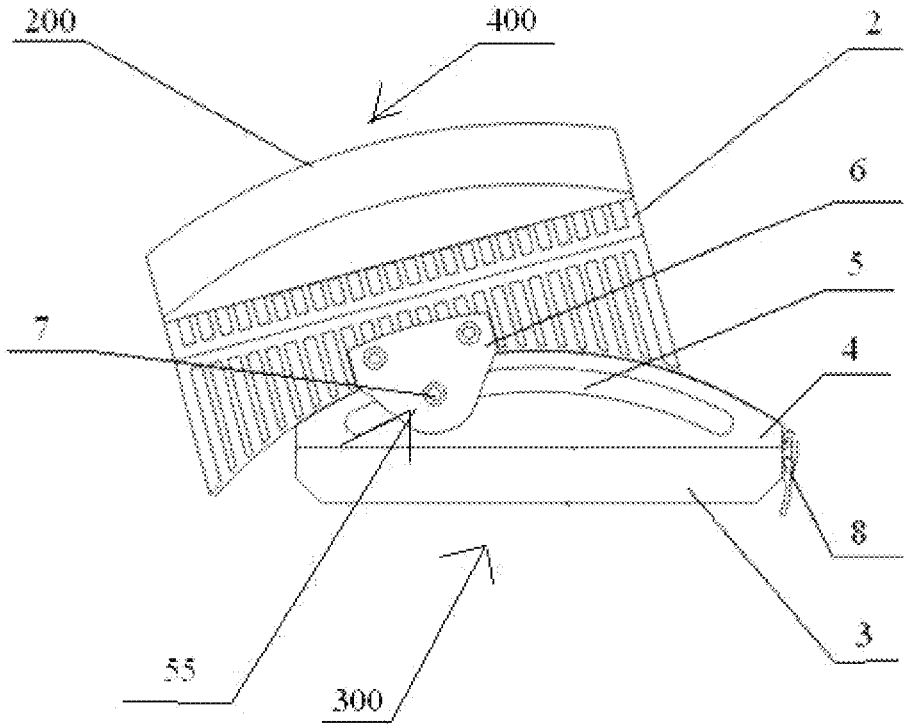
FIG. 5 is a top view of a wireless base station according to Embodiment 1 of the present disclosure.
Figure 6:
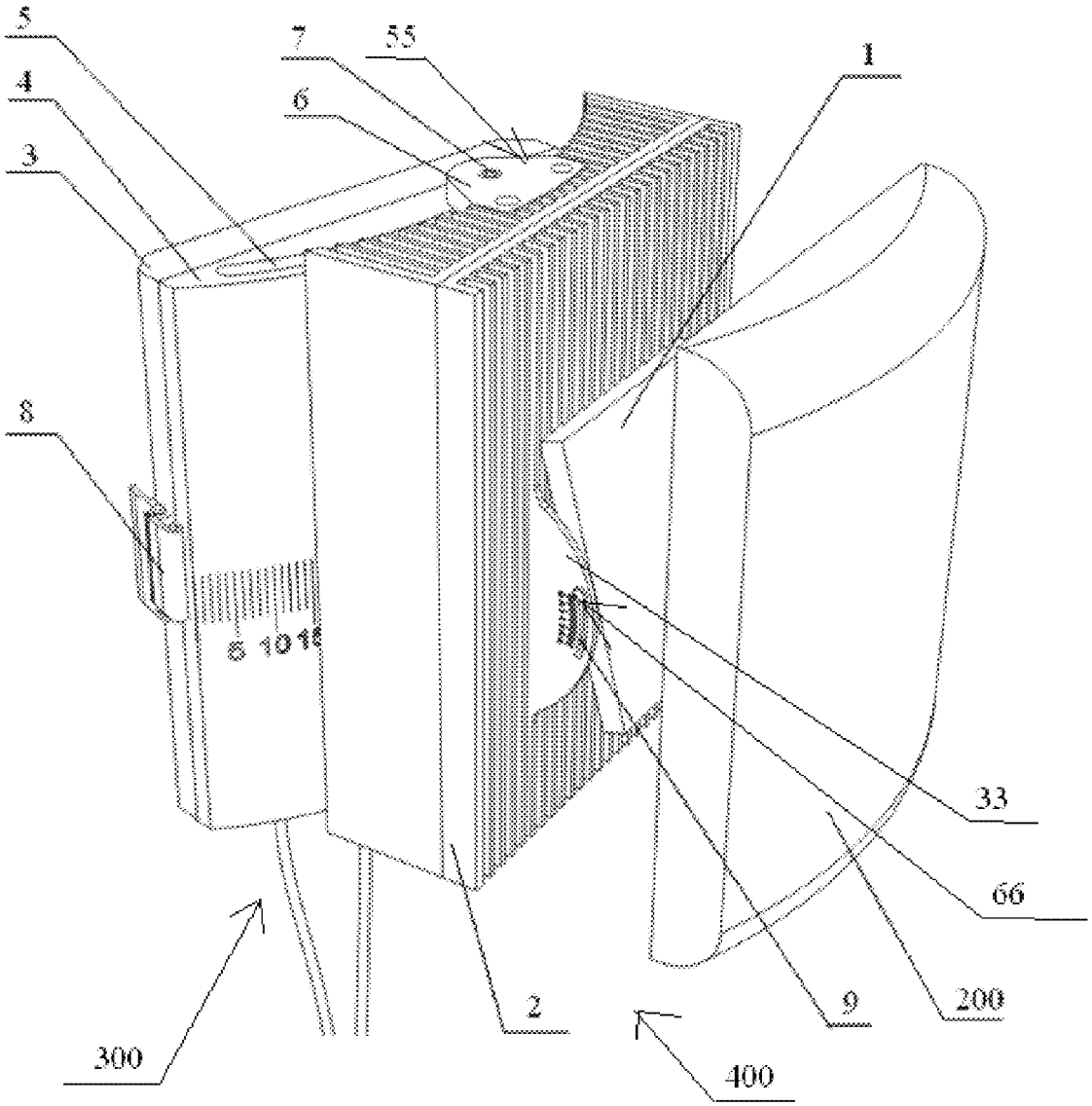
FIG. 6 is a schematic diagram of a wireless base station when an antenna of the wireless base station is visible according to Embodiment 1 of the present disclosure.

As shown in FIG. 5, the adapter portion 4 is in a rotating door-shaped structure, where a side of the adapter portion 4 with the rotating door-shaped structure is pivotally connected to a side of the supporting module 300, and another side is fitted to another side of the supporting module 300 using a latch 8 or a pin; or the adapter portion 4 with the door-shaped structure is slidably disposed on the body 3 in a push-pull manner, so that the mechanism for adjusting the angle of the antenna 1 can be formed integrally with the base transceiver station 2 and the antenna 1, and move together with the adapter portion 4 with the door-shaped structure to be far away from or close to the supporting module 300. In this way, when the supporting module 300 is being maintained, the adapter portion 4 with the door-shaped structure is opened to reveal the supporting module 300 for ease of maintenance; after maintenance is completed, the adapter portion 4 with the door-shaped structure is closed, which is easy to operate and convenient. In addition, the adapter portion 4 with the door-shaped structure not only plays a role of an adapter between the supporting module 300 and the mechanism for adjusting the angle of the antenna 1, but also may be used as a maintenance cover for the supporting module 300, achieving a compact structure.

The foregoing descriptions are merely specific embodiment of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A wireless base station, comprising:

a support;

a base station; and a first connecting part, wherein the base station is slidably disposed on the support in a first sliding direction using the first connecting part, wherein a first sliding slot matching the first connecting part is disposed on the support so as to limit a sliding track and a sliding range of the base station, wherein the first connecting part descends into the first sliding slot, wherein the first sliding slot is in an arc shape, wherein the base station includes a first side face providing a concave recess, wherein the support includes a second side face providing a convex surface, and wherein the convex surface of the second side face is received within the concave recess of the first side face.

2. The wireless base station according to claim 1, wherein the first side face and the second side face match each other in shape to prevent interference from the support when the base station slides in the first sliding direction.

3. The wireless base station according to claim 2, wherein the first sliding slot is disposed on an end face on the support, adjacent to the second side face of the support, and corresponds to the first connecting part, and wherein a curvature of the first sliding slot is consistent with the curvature of the first side face of the base station.

4. The wireless base station according to claim 2, wherein a curvature of the first side face is greater than or equal to curvature of the second side face.

5. The wireless base station according to claim 4, wherein the first sliding slot is disposed on an end face on the support, adjacent to the second side face of the support, and corresponds to the first connecting part, and wherein a curvature of the first sliding slot is consistent with the curvature of the first side face of the base station.

6. The wireless base station according to claim 1, wherein the base station comprises a base transceiver station, an antenna, and a second connecting part, wherein the antenna is slidably disposed on the base transceiver station in a second sliding direction using the second connecting part, and wherein the first side face of the base station is formed on the base transceiver station on an opposite side of a side on which the antenna is disposed.

7. The wireless base station according to claim 6, wherein a second sliding slot matching the second connecting part is disposed on the base transceiver station so as to limit a sliding track and a sliding range of the antenna, wherein the second sliding slot is in an arc shape, and wherein the second sliding slot is disposed on a projection that is on the base transceiver station and is on a side adjacent to the antenna.

8. The wireless base station according to claim 7, wherein a scale that is distributed along the second sliding slot is disposed on a side face of the projection.

9. The wireless base station according to claim 7, wherein an inner wall of the second sliding slot is smooth, and the second connecting part comprises a sliding block part and a fixed part, wherein the fixed part is disposed on an end face of the antenna, and wherein the sliding block part is disposed inside the second sliding slot.

10. The wireless base station according to claim 7, wherein the second sliding slot has a toothed inner wall, wherein the second connecting part comprises a gear part and a fixed part, wherein the fixed part is disposed on an end face of the antenna, and wherein the gear part is disposed inside the second sliding slot.

11. The wireless base station according to claim 6, wherein the first sliding direction is perpendicular to the second sliding direction.

12. The wireless base station according to claim 6, wherein an inner wall of the first sliding slot is smooth, wherein the first connecting part comprises a sliding block part and a fixed part, wherein the fixed part is disposed on an end face of the base transceiver station, and wherein the sliding block part is disposed inside the first sliding slot.

13. The wireless base station according to claim 6, wherein teeth are provided on an inner wall of the first sliding slot, wherein the first connecting part comprises a gear part and a fixed part, wherein the fixed part is disposed on an end face of the base transceiver station, and wherein the gear part is disposed inside the first sliding slot and meshes with the teeth that are on the inner wall of the first sliding slot.

14. The wireless base station according to claim 1, wherein the support has a scale that is located on the second side face and is along the first sliding slot so that a degree that the base station slides relative to the support is recorded.

15. The wireless base station according to claim 1, wherein the support comprises a body and an adapter portion that is mounted to the body and that may move relative to the body so that the adapter portion drives the base station to rotate together with the adapter portion relative to the body of the support, and wherein the first sliding slot on the support is separately disposed on an upper end face and a lower end face of the adapter portion.

16. The wireless base station according to claim 15, wherein the adapter portion is formed in a door-shaped structure, wherein a side of the adapter portion with the door-shaped structure is pivotally connected to a side of the body, and wherein an opposite side of the adapter portion with the door-shaped structure is fitted to another side of the body using a latch or a pin.

17. The wireless base station according to claim 15, wherein the adapter portion is formed in a door-shaped structure, and wherein the adapter portion with the door-shaped structure is slidably disposed on the body in a push-pull manner.

* * * * *